US005665205A

United States Patent [19]

Srivatsa et al.

[11] Patent Number: 5,665,205

[45] Date of Patent: Sep. 9, 1997

[54] METHOD FOR IMPROVING BRIGHTNESS AND CLEANLINESS OF SECONDARY FIBERS FOR PAPER AND PAPERBOARD MANUFACTURE

[75] Inventors: Narendra R. Srivatsa, Ramsey; Sanjay Patnaik, Westwood, both of N.J.; Paul Hart, Georgetown, S.C.; Thomas E. Amidon, Highland Mills, N.Y.; Jean J. Renard, Mobile, Ala.

[73] Assignee: International Paper Company, Purchase, N.Y.

[21] Appl. No.: 375,026

[22] Filed: Jan. 19, 1995

[51] Int. Cl.[6] ..... D21H 17/64

[52] U.S. Cl. ..... 162/181.4; 162/9; 162/183; 162/158; 162/181.1

[58] Field of Search ..... 162/158, 181.1, 162/181.2, 181.4, 182, 183, 185, 9

[56] References Cited

U.S. PATENT DOCUMENTS

| | | | |
|---|---|---|---|
| 1,595,416 | 8/1926 | Rafsky . | |
| 5,096,539 | 3/1992 | Allan | 162/9 |
| 5,122,230 | 6/1992 | Nakajima | 162/157.1 |
| 5,156,719 | 10/1992 | Passaretti | 162/158 |
| 5,215,734 | 6/1993 | Kunesh et al. | 423/430 |
| 5,219,660 | 6/1993 | Wason et al. | 428/403 |
| 5,223,090 | 6/1993 | Klungness et al. | 162/9 |
| 5,275,699 | 1/1994 | Allan et al. | 162/181.2 |

FOREIGN PATENT DOCUMENTS

| | | | |
|---|---|---|---|
| 0 447 094 A1 | 9/1991 | European Pat. Off. | C01F 11/18 |
| 2 689 530 | 10/1993 | France . | |
| 62-162098 | 7/1987 | Japan | 162/9 |

OTHER PUBLICATIONS

Fairchild, George H., "Increased Filler Levels in Alkaline Paper Using PCC Technology", *Alkaline Papermaking, A TAPPI PRESS Anthology of Published Papers*, pp. 180–185, Atlanta, Georgia (1992).

*Primary Examiner*—Donald E. Czaja
*Assistant Examiner*—Jose A. Fortuna
*Attorney, Agent, or Firm*—Ostrager, Chong & Flaherty

[57] ABSTRACT

A high level of calcium carbonate filler is added to secondary fiber pulp by in situ attachment to the secondary fibers. The secondary fiber pulp is mixed with an alkaline salt such as calcium oxide or calcium hydroxide and contacted with a reaction gas such as carbon dioxide in a gas-liquid contactor apparatus through efficient mixing in order to precipitate filler material such as calcium carbonate crystal complexes on the secondary fibers. The resulting pulp products have comparable or, in some cases, better brightness, cleanliness, and other sheet properties as compared to filler addition by conventional methods.

10 Claims, 8 Drawing Sheets

METHOD FOR IMPROVING BRIGHTNESS AND CLEANLINESS OF SECONDARY FIBERS FOR PAPER AND PAPERBOARD MANUFACTURE

TECHNICAL FIELD

This invention generally relates to the use of secondary fibers for paper and paperboard manufacture, and more particularly, to a method for improving the brightness and cleanliness of secondary fibers by addition of high levels of filler material on the fibers.

BACKGROUND OF INVENTION

In paper and paperboard manufacture, fillers are added to increase the brightness and opacity of paper, as well as for other advantages such as improved smoothness, printability, and lower material costs. Fillers are fine particles of insoluble mineral material which are impregnated in and among the paper pulp fibers. Alkaline fillers, such as calcium carbonate, are commonly used due to the prevalence of alkaline process conditions in paper manufacture. It has become desirable to load paper with as much filler as possible to obtain the desired properties without degrading the strength of the paper by interfering with the bonding between fibers.

Filler is added to paper conventionally by mixing or precipitating filler material in a paper pulp slurry so that it is retained in the pores and spaces between and among the paper fibers. However, filler addition to the pulp slurry leads to waste of large amounts of filler material as residue and requires further processing to remove the filler material from waste water in the papermaking process. Other techniques, for example, as disclosed in U.S. Pat. No. 5,122,230 to Nakajima and U.S. Pat. No. 5,233,090 to Klungness et al., have provided for in situ attachment of filler in the pulp by using the hydrophilic properties of virgin cellulosic fibrils to take up a salt-containing solution, then contacting the salt-laden pulp fibers with a gas or aqueous agent to precipitate the filler particles on the surface of or within the fibers.

For environmental reasons and the reduction of solid waste, increasing amounts of paper are being recycled today. The recycling of paper requires repulping fiber from waste paper, referred to in the industry as secondary fiber pulp. Secondary fiber pulp may be deinked or undeinked. Deinked pulp is produced by any one of the known methods for contaminant and ink removal with or without bleaching. However, it is also common to use secondary fiber pulp that has not been deinked for the manufacture of some types of paper.

Heretofore, filler has been added to secondary fiber pulp during papermaking. As explained above, filler addition to the pulp slurry leaves large amounts of the filler material as residue and requires further processing for its removal. Secondary fibers when repulped are different mechanically and chemically from virgin fibers because they have charged species, ink, surface-active agents, etc., that can interfere with the deposition of filler precipitate on the fibers. Secondary fibers also have different bonding characteristics and may be hydrophobic or hydrophilic, compared to virgin fibers which are hydrophilic. Thus, in situ attachment of filler precipitate has not been used for secondary fibers.

SUMMARY OF INVENTION

In the present invention, a method is provided for depositing a high level of filler in secondary fiber pulp by in situ attachment of precipitate to the secondary fibers. The method for producing high-filler-content secondary fibers involves mixing secondary fiber pulp with an alkaline salt, such as calcium oxide or calcium hydroxide (lime), and contacting the mixture with a gas such as carbon dioxide gas in a gas-liquid contactor apparatus through efficient mixing in order to precipitate filler materials like calcium carbonate crystal complexes attached to the secondary fibers.

The preferred form of alkaline salt for precipitated calcium carbonate (PCC) is calcium hydroxide. Alternate salts and gases can be used to precipitate other filler materials onto the secondary fiber substrate. The preferred parameters for this method, apart from efficient, high-shear mixing, are pulp consistency of from 0.1% to 5%, process temperature of from 15° C. to 80° C., and $CO_2$/lime molar ratio of from 0.1 to 10. The reaction product's size and shape can be controlled by these parameters and by the level of mixing or reaction time.

Other objects, features, and advantages of the present invention will be explained in the following detailed description of the invention having reference to the appended drawings.

DETAILED DESCRIPTION OF INVENTION

Figure 1:
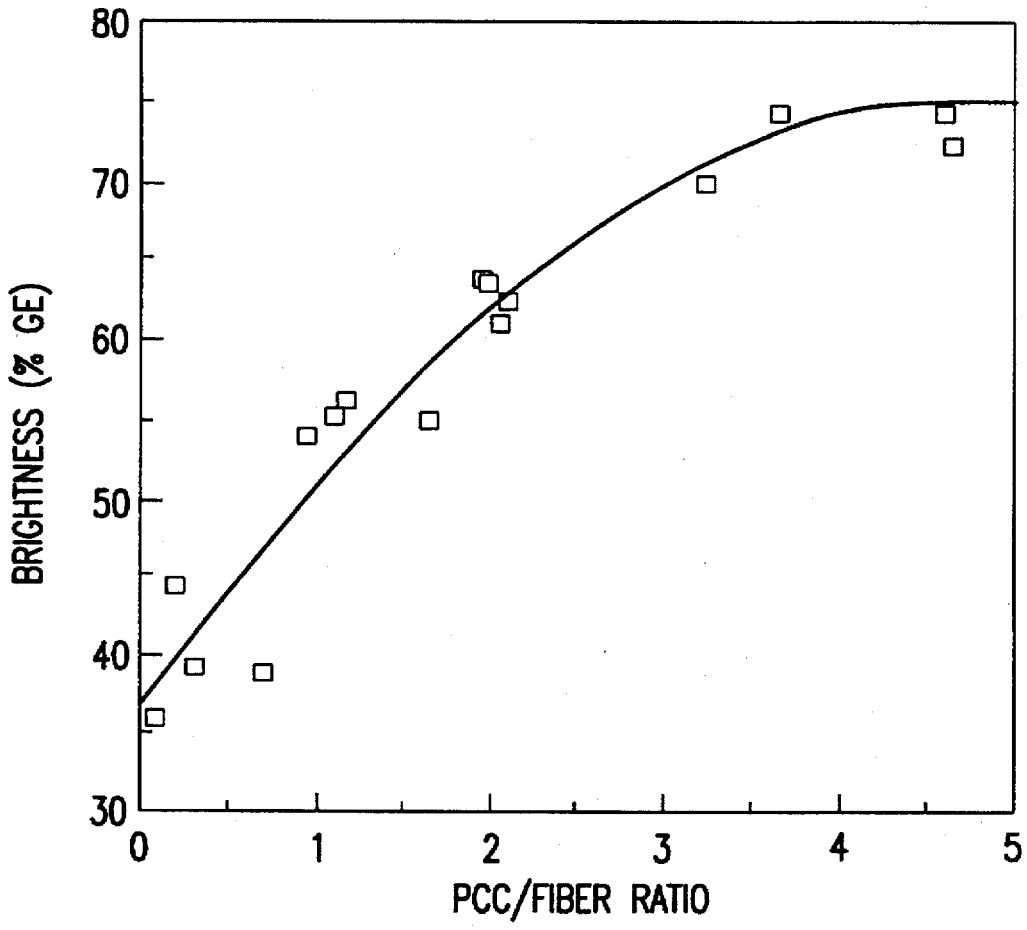
FIG. 1 is a graph showing brightness in relation to the ratio by weight of precipitated calcium carbonate (PCC) to undeinked newsprint fiber as obtained in the method of the present invention.

In accordance with the invention, a high level of filler is deposited in secondary fiber pulp by high-shear mixing of the secondary fiber pulp with a water-insoluble or low-soluble alkaline salt, such as calcium oxide or calcium hydroxide (lime). The secondary fiber pulp is repulped from recycled waste paper, and may be deinked or undeinked. Its residual surface properties may be hydrophobic or hydrophilic. The pulp is not dewatered (water removed below the free moisture level) but preferably has a consistency of anywhere from about 0.1% to 5% (fibers containing from about 99.9% to 95% of moisture). Higher consistencies would not be suitable in a continuous flow process. The calcium oxide or calcium hydroxide is mixed with the secondary fiber pulp in a separate step or in a gas-liquid contactor apparatus.

The gas-liquid contactor apparatus may be of any suitable type which produces high interfacial contact. For example, a mixing tank with gas sparging would be adequate. Carbon dioxide gas is contacted with the mixture while it is being mixed, such as by sparging the gas through a distributor plate in the apparatus. The molar ratio of carbon dioxide to lime is preferably in the range of 0.1 to 10. The process temperature may be maintained at ambient temperature or at an elevated temperature, e.g., from 15° C. to 80° C., based on the solubility of gas and reactants.

A more detailed description of suitable gas/liquid contactor apparatus, preferred process steps, and parameters for carrying out the objective of depositing a high level of filler in secondary fiber pulp by in situ attachment of precipitate to secondary fibers is provided in the commonly owned U.S. patent application Ser. No. 08/375,485, of M. C. Matthew, Sanjay Patnaik, Paul Hart, and Thomas E. Amidon, entitled "Process for Enhanced Deposition and Retention of Particulate Filler on Papermaking Fiber," filed concurrently herewith, which is incorporated herein by reference.

The result of carbon dioxide gas contact with the pulp/lime slurry mixed with the high-shear action is a secondary fiber pulp mixture having a high content of precipitated calcium carbonate (PCC) complex attached in situ to the fibers in any desired amount. The useful limit based on the desired resulting product may have an upper limit of perhaps 600% by weight of PCC filler to fiber. The surprising result obtained is that this method can provide a higher amount of filler retained by the secondary fibers with equal or better sheet properties than when the filler is added in the pulp slurry using conventional filler addition methods.

In the following examples, precipitated calcium carbonate (PCC) was deposited in situ on secondary fibers by mixing calcium hydroxide in a pulp slurry and contacting with carbon dioxide gas in a gas-liquid contactor. The amount of PCC deposited on the fibers was varied by varying the amounts of calcium hydroxide and carbon dioxide. The procedure was carried out on various types of recycled fibers, with the described results.

EXAMPLE I

Various amounts of precipitated calcium carbonate (PCC) were applied in situ on undeinked newsprint pulp. The PCC/fiber ratio was varied from zero to almost 5/1, and brightnesses in percent was measured for the resulting papers using a standard industry unit measure (GE) for brightness. FIG. 1 shows a graph of the brightness achieved compared to the PCC/fiber ratio for pulp from old newsprint (ONP). The results show that brightness increased from 35% GE to 74% GE at about a 4.7/1 ratio. In terms of cleanliness, the resulting sheets having high levels of filler added showed no ink specks.

Figure 2:
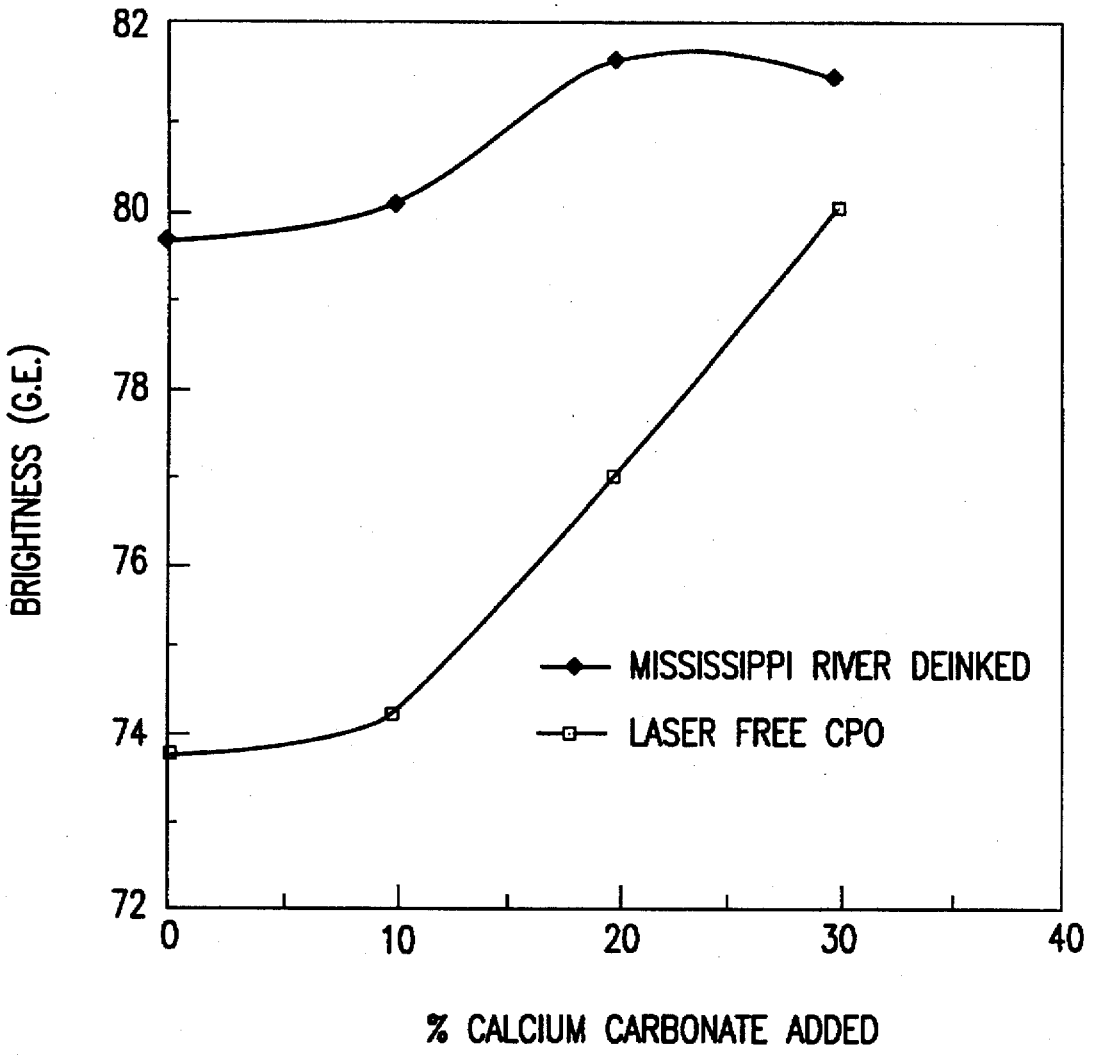
FIG. 2 is a graph showing brightness in relation to the percentage by weight of PCC added for deinked pulp and undeinked laser-free CPO pulp.

EXAMPLE II various amounts of PCC were applied in situ on purchased deinked pulp and undeinked laser-free computer printout (CPO) wastepaper. The brightness vs. PCC/fiber ratio is shown in FIG. 2. The brightness increased in all cases with increasing PCC addition. The brightness of laser-free CPO is seen in all cases as approaching that of purchased deinked pulp. This showed that the effect of PCC addition on undeinked pulp approached that for deinked pulp. Similar results were observed using in-situ addition of PCC to deinked sorted white ledger paper pulp.

EXAMPLE III

The pulp prepared in Examples I and II was used in making a multi-ply product with the top ply containing PCC-fiber complex at a weight up to 30% of the total sheet weight. The product was a good white-top or mottle white type of product meeting the optical specifications and many of the strength specifications for standard product. The following Table I shows a comparison of PCC addition for four samples: (A) undeinked newsprint with 2/1 PCC/fiber ratio; (B) deinked ledger pulp without PCC applied; (C) deinked ledger pulp with 2/1 PCC/fiber ratio; and (D) deinked ledger pulp with 1/1 PCC/fiber ratio. The results showed that the addition of PCC-fiber complex does not significantly degrade other sheet properties when compared to using the recycled fiber alone. This indicates opportunities for using low-cost recycled fiber and producing recycled paper products having improved brightness and cleanliness.

Figure 3:
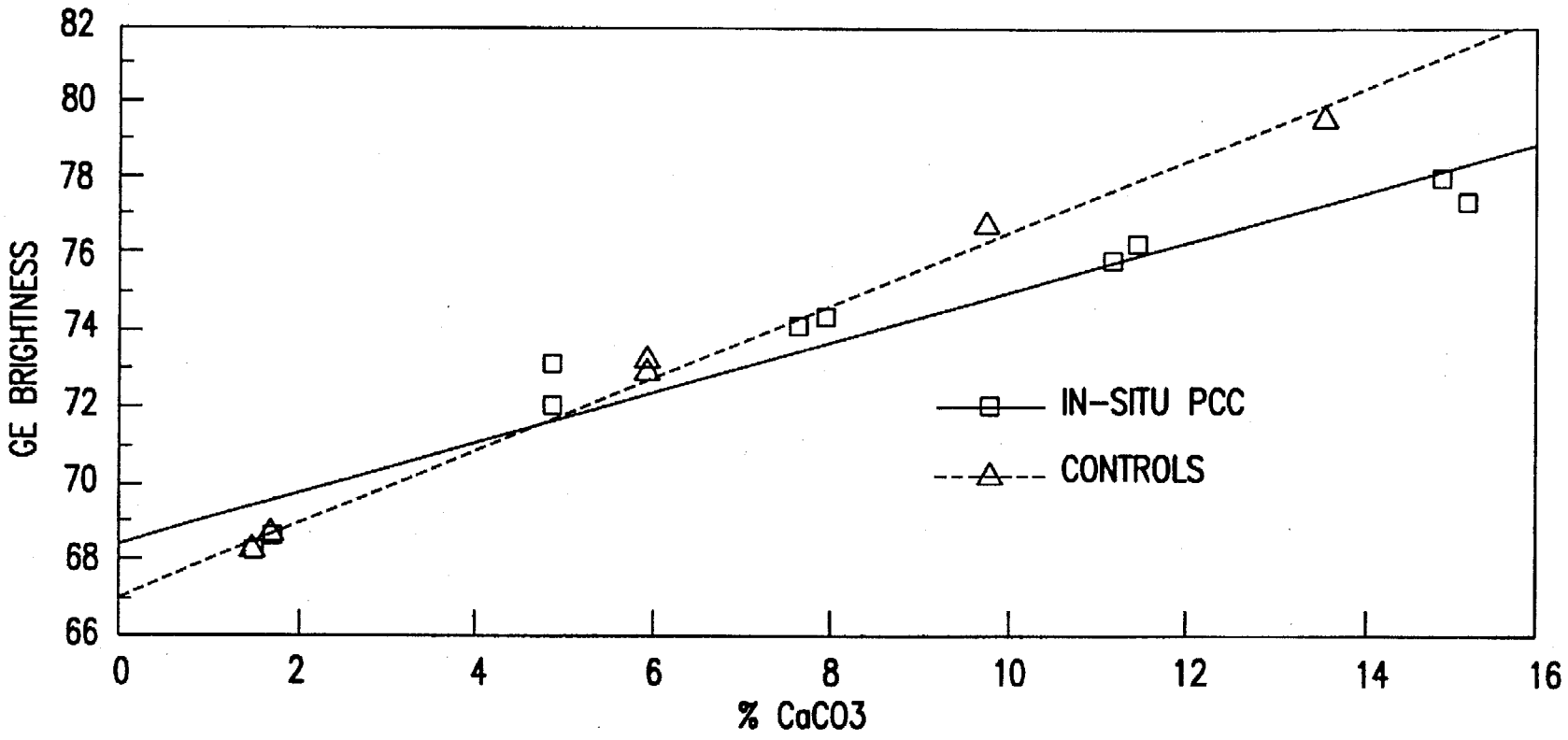
FIGS. 3 and 4 compare brightness and stiffness in relation to percent of PCC for a mottle white type of paper product using the invention and a conventional filler addition method.
Figure 4:
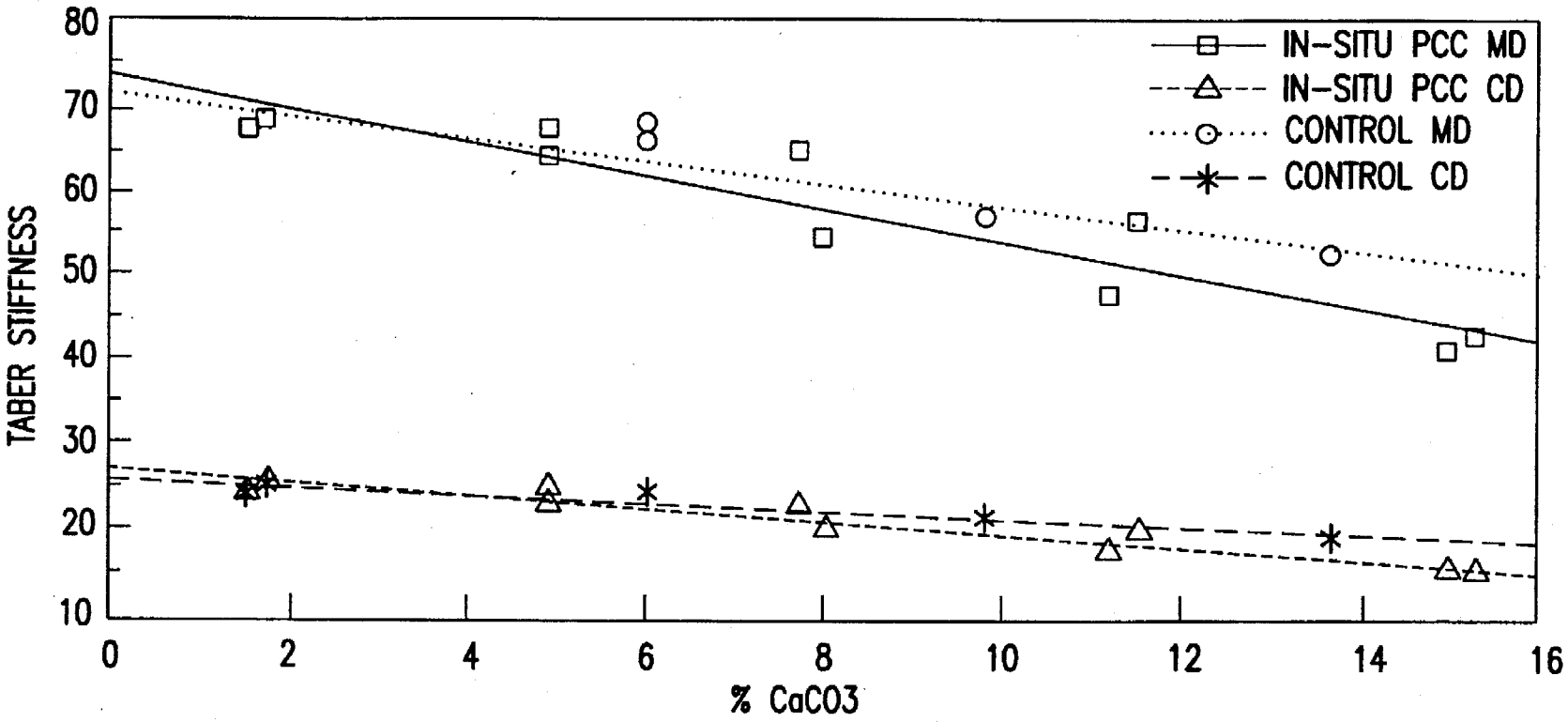
Figure 5:
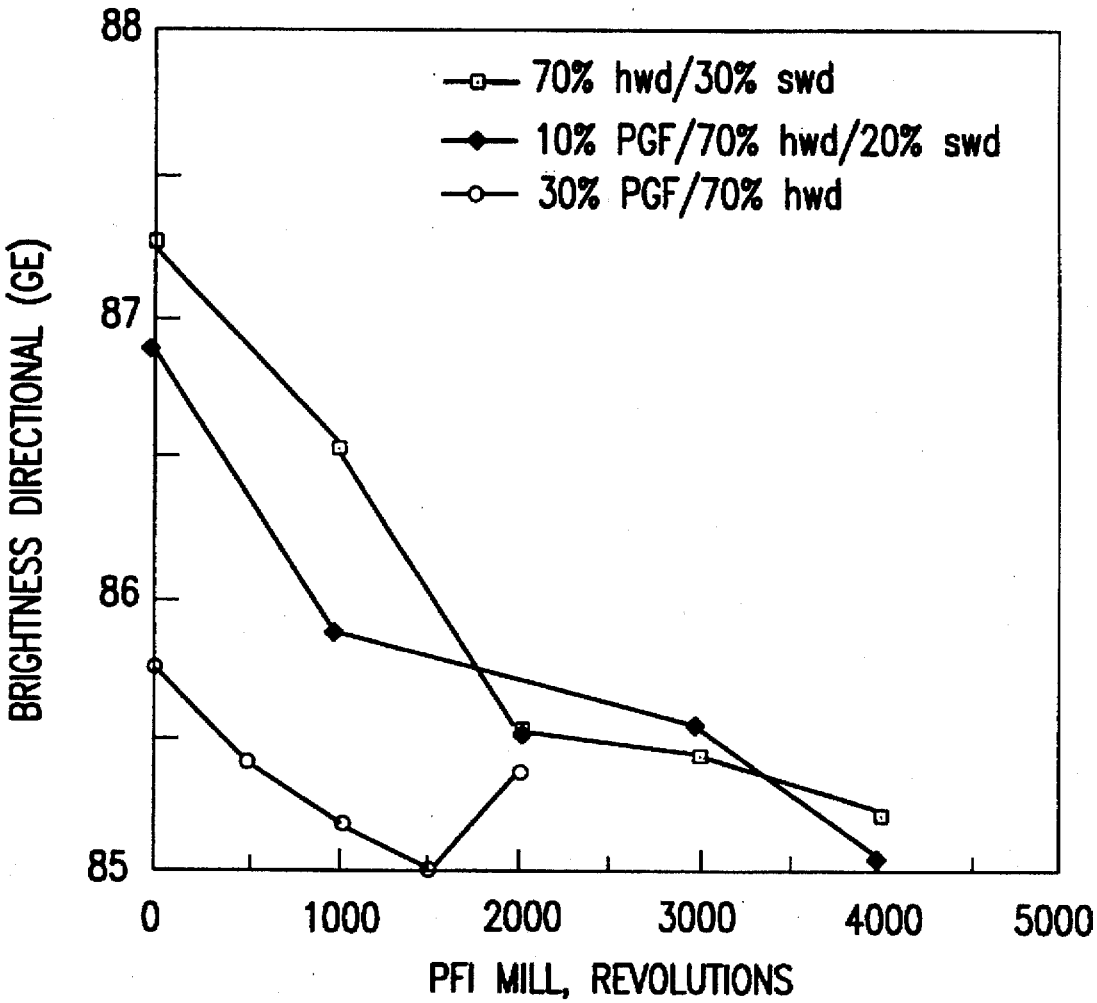
FIGS. 5 to 8 compare brightness, tear strength, tensile strength, and freeness in relation to the refining energy required for producing filled-loaded secondary fiber pulp in the invention and virgin fiber pulp.
Figure 6:
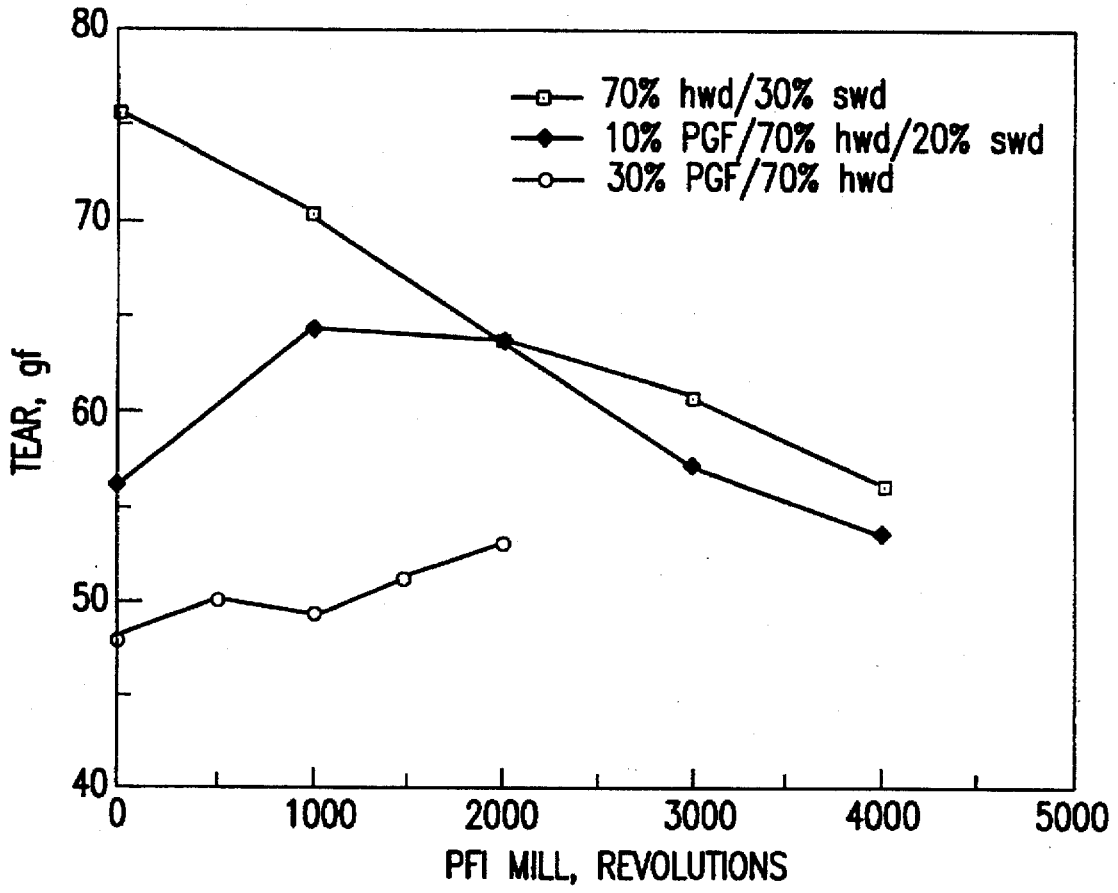
Figure 7:
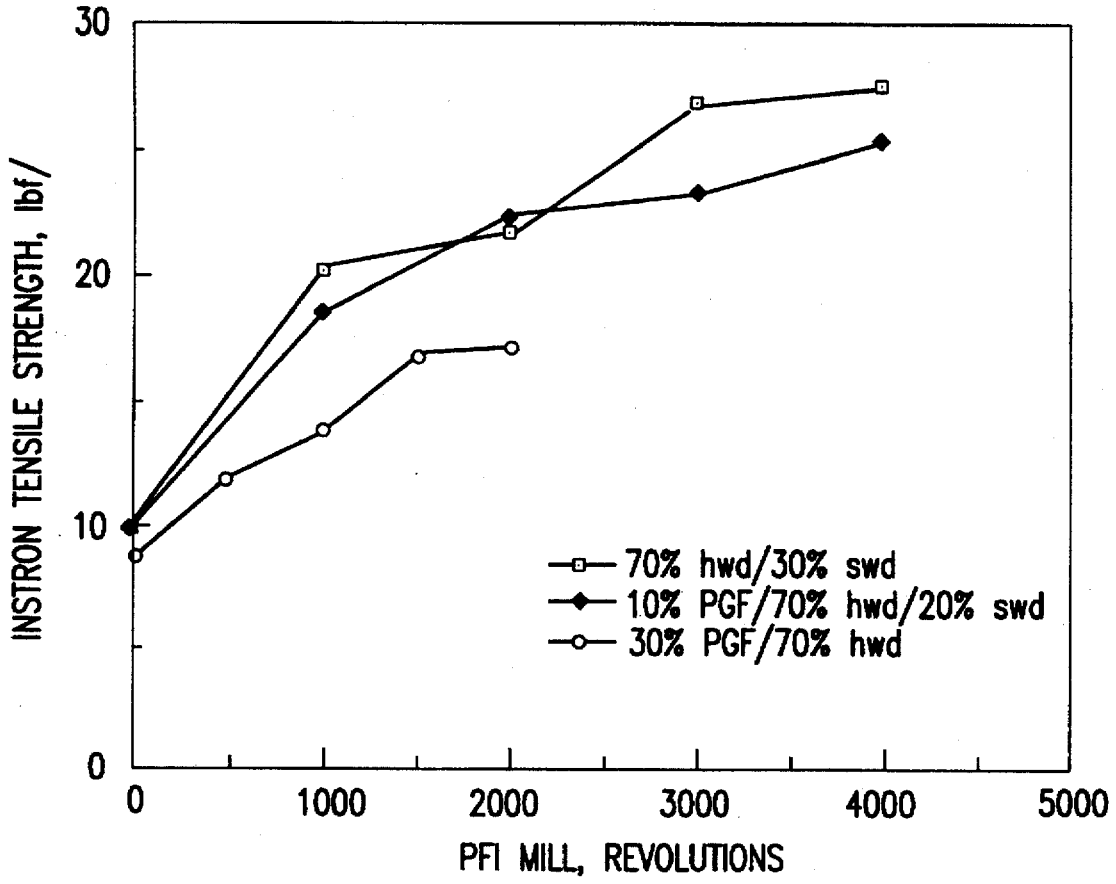
Figure 8:
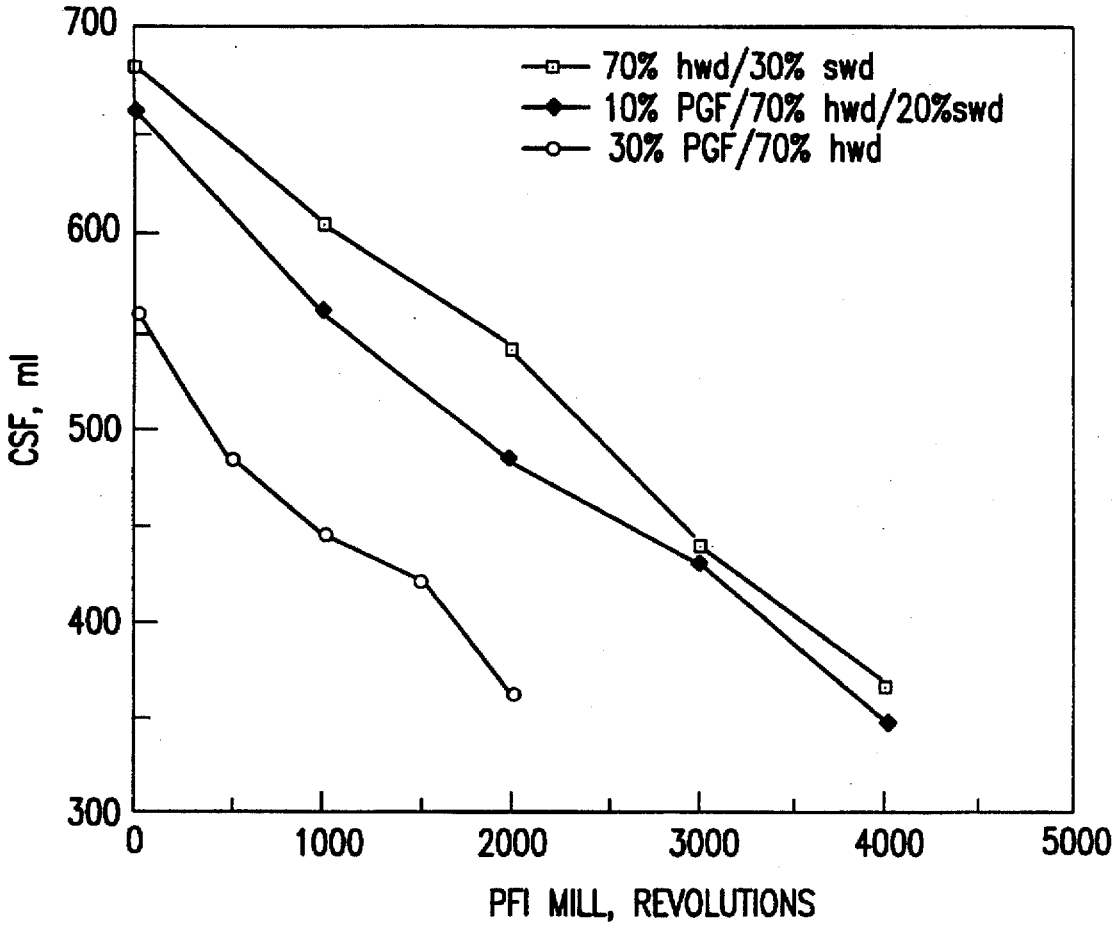

FIGS. 3 and 4 show comparisons of brightness and machine-direction (MD) and cross-direction (CD) stiffness of mottle white type product for in-situ addition of PCC contrasted to control samples obtained by conventional blending of PCC in pulp slurry. The results showed comparable brightness and stiffness for the same percentage amounts by weight of PCC retained to total sheet weight. In these tests, the in-situ addition method was observed to result in a higher level of retention of PCC through the papermaking process.

EXAMPLE IV

The pigmented (PGF) pulps prepared in Example II were blended with various hardwood and softwood pulps for kraft paper. Three samples were tested: (1) a control of 70% hardwood and 30% softwood virgin kraft pulp; (2) a blend of 70% hardwood, 20% softwood, and 10% PCC-fiber complex; and (3) a blend of 70% hardwood and 30% PCC-fiber complex. The brightness, tear strength in gram/force (gf), tensile strength in pound-force (lbf) using a standard Instron tester, and freeness in CSF (Canadian standard freeness unit) per mL were measured at various levels of beater refining energy in terms of mill revolutions, and are shown in the graphs of FIGS. 5–8, respectively.

The results showed that at typical freeness levels of interest in commodity white paper grades around 400–500 CSF, the physical properties of the sample sheets were not greatly affected by the substitution of PCC-fiber complex pulp. The PCC-fiber complex contained over 40% by weight of PCC.

The above examples show that in-situ PCC application produces recycled pulp (deinked or undeinked, or containing groundwood or chemical pulps) can be used in paper and paperboard applications with comparable or, in some cases, better resulting sheet properties. Since the cost of producing in-situ PCC-fiber complex is significantly cheaper than virgin pulp, significant economic advantages of using the recycled pulp can be realized.

It is further found that the sequence of introduction of the fiber slurry, the calcium hydroxide slurry and the gaseous carbon dioxide to the contact zone in the gas/liquid contactor may be varied to achieve a desired pH of the flowing stream within the contact zone and, consequently, the pH of the resulting filled fiber slurry. This is particularly important for certain types of secondary fibers which can darken under conditions of high alkalinity. For example, pre-mixing the fiber slurry (commonly at a pH of about 6.0 to 8.0) and a calcium hydroxide slurry prior to their introduction into the contact zone results in a pH of the combined slurries in the contact zone of about 11.0 which is too alkaline for the successful processing of certain alkaline-sensitive secondary fibers containing lignin which discolor under such alkaline conditions, such as recycled pulp from old newsprint/magazines. It has been found that by introducing at least a portion of the total quantity of carbon dioxide required for the conversion of the calcium hydroxide at a location along the length of the contact zone downstream of the introduction point of the fiber slurry, but upstream of the introduction point of the calcium hydroxide slurry, one can develop a pH of the flowing stream within the contact zone of about 9.0, a value which is acceptable for those fibers which are alkaline-sensitive. The carbon dioxide preferably can be introduced into the contact zone at two (or more) separated inlet ports, and the calcium hydroxide slurry can likewise be split into two (or more) incoming streams and introduced into the contact zone at locations which alternate (in a regular or irregular pattern) with respect to the inlet ports for the carbon dioxide. In this manner, the pH of the flowing stream within the contact zone can remain at about 9.0 until the final introduction of carbon dioxide which reduces the pH of the flowing stream to a desired output pH of about 6.0 to 8.0.

The described method of in-situ PCC addition may be varied by using other sources for carbon dioxide gas, such as flue gas, or for lime. The crystal shape and size of the PCC can be controlled by varying the mixing and gas-contact parameters. Appropriate papermaking additives may be used to enhance properties as deemed necessary. The type and amount of secondary fiber can be varied for desired product variations. Other types of precipitate deposition may also be obtained using this technique for mixing alternate salts and gases in a gas/liquid contactor. Other alkaline salts such as magnesium hydroxide, etc., may be used. Different sheet properties and products can be obtained using different types of wastepaper pulps.

Although the method of the present invention has been described with respect to certain examples and process parameters, it is understood that various modifications may be made given the principles of the invention disclosed herein. It is intended that all such modifications and variations are included within the spirit and scope of this invention, as defined in the following claims.

We claim:

1. A method for adding filler to secondary fibers pulp for manufacture of paper or paperboard products, comprising the steps of:

introducing secondary fiber pulp slurry into a gas-liquid contactor apparatus at a location upstream of a contact zone thereof, and also introducing an alkaline salt slurry at a location downstream of the introduction point of the secondary fiber pulp and approximate to the contact zone;

combining the two slurries in the contact zone and immediately contacting said combined slurries with a suitable reaction gas in said contact zone, and mixing so as to precipitate filler complexes onto the secondary pulp fibers; and using the secondary pulp fiber with filler precipitated thereon for the manufacture of paper or paperboard products.

2. A method for adding filler to secondary fiber pulp according to claim 1, wherein the secondary fiber pulp is deinked pulp repulped from waste paper.

3. A method for adding filler to secondary fiber pulp according to claim 1, wherein the secondary fiber pulp is undeinked pulp repulped from waste paper.

4. A method for adding filler to secondary fiber pulp according to claim 1, wherein the alkaline salt is calcium hydroxide.

5. A method for adding filler to secondary fiber pulp according to claim 4, wherein the gas is carbon dioxide.

6. A method for adding filler to secondary fiber pulp according to claim 1, wherein the secondary fiber pulp has a pulp consistency of from 0.1% to 5%.

7. A method for adding filler to secondary fiber pulp according to claim 1, wherein the mixing and gas contacting steps are carried out at a temperature of from 15° C. to 80° C.

8. A method for adding filler to secondary fiber pulp according to claim 1, wherein the molar ratio of gas to alkaline salt is from 0.1 to 10.

9. A method for adding filler to secondary fiber pulp according to claim 5, wherein the molar ratio of carbon dioxide to calcium hydroxide is from 0.1 to 10.

10. A method of adding filler to secondary fiber pulp according to claim 1, wherein a portion of the reaction gas is introduced into the gas-liquid contactor apparatus at a location downstream Of the introduction location of the secondary pulp fiber slurry but upstream of the alkaline salt slurry.

* * * * *

UNITED STATES PATENT AND TRADEMARK OFFICE

CERTIFICATE OF CORRECTION

PATENT NO. : 5,665,205
DATED : September 9, 1997
INVENTOR(S) : Srivatsa et al.

It is certified that error appears in the above-indentified patent and that said Letters Patent is hereby corrected as shown below:

Col. 2 line 40 delete "filled-loaded" and insert - filler-loaded -;

Col. 3 line 46 delete "various" and insert - Various -;

In Claim 1, Col. 5 line 34 delete "fibers" and insert - fiber - ;

Signed and Sealed this

Seventeenth Day of February, 1998

Bruce Lehman

*Attest:*

BRUCE LEHMAN

*Attesting Officer*

*Commissioner of Patents and Trademarks*